US010077548B2

(12) United States Patent
Huang

(10) Patent No.: US 10,077,548 B2
(45) Date of Patent: Sep. 18, 2018

(54) TOILET TANK LEVER FOR DIFFERENT TOILETS

(71) Applicant: Li-Chen Huang, Changhua (TW)

(72) Inventor: Li-Chen Huang, Changhua (TW)

(73) Assignee: Alexander Yeh Industry Co. Ltd., Changhua (TW)

( * ) Notice: Subject to any disclaimer, the term of this patent is extended or adjusted under 35 U.S.C. 154(b) by 62 days.

(21) Appl. No.: 15/391,642

(22) Filed: Dec. 27, 2016

(65) Prior Publication Data

US 2018/0179745 A1 Jun. 28, 2018

(51) Int. Cl.
*E03D 5/092* (2006.01)

(52) U.S. Cl.
CPC ..... *E03D 5/092* (2013.01)

(58) Field of Classification Search
CPC ..... E03D 5/092; E03D 5/09; E03D 5/094; E03D 5/02; E03D 5/04; E03D 5/06; E03D 5/08
USPC ..... 4/412–414; 403/119; 16/260
See application file for complete search history.

(56) References Cited

U.S. PATENT DOCUMENTS 6,092,245 A * 7/2000 Jones ..... E03D 5/092 4/405
2005/0273919 A1* 12/2005 Berlovan ..... E03D 5/092 4/405
2016/0376780 A1* 12/2016 Yang ..... E03D 5/092 4/249

* cited by examiner

*Primary Examiner* — Janie Loeppke
(74) *Attorney, Agent, or Firm* — Che-Yang Chen; Law Offices of Scott Warmuth

(57) ABSTRACT

A toilet tank lever may comprise a flush handle, a first connecting rod and a second connecting rod. The flush handle is configured for flushing toilet, and a column protrudes from an inner surface thereof. The first connecting rod has a fixed section and a lever section, and the second connecting rod comprises a first end and a second end. The first connecting rod and the second connecting rod are pivotally connected with an adjustable included angle such that the toilet tank lever of the present invention is configured to be applied to different types of toilet water tanks, thereby improving the practicability thereof.

7 Claims, 12 Drawing Sheets

TOILET TANK LEVER FOR DIFFERENT TOILETS

FIELD OF THE INVENTION

The present invention relates to a toilet tank lever, and more particularly to a toilet tank lever suitable for different types of toilet tanks.

BACKGROUND OF THE INVENTION

According to the installation positions of a handle on a toilet water tank, generally, a toilet tank lever has three main types which are front-mount lever, side-mount lever and angle-mount lever. Since said three types of levers are respectively applied to different types of toilet water tanks, when a user's toilet tank lever broken, the user may need to waste time to figure out the type of their lever before replacing, which is inconvenient. Therefore, there remains a need for a new and improved design for a toilet tank lever to overcome the problems presented above.

SUMMARY OF THE INVENTION

The present invention provides a toilet tank lever which comprises a flush handle, a first connecting rod and a second connecting rod. The flush handle is configured to control a toilet to flush, and a column protrudes from an inner surface thereof. A locating piece disposed on the column is configured to have preferred rotations when the flush handle is pressed for flushing toilet. A threaded section formed on an outer periphery of the locating piece is configured to engage with a locating nut. Moreover, an end portion of the column is configured to connect to the first connecting rod. The first connecting rod has a fixed section and a lever section. Wherein the fixed section is configured to connect to the column of the flush handle such that the flush handle is configured to drive the first connecting rod through the column to move simultaneously. The lever section has a lateral opening, and two engaging portions are respectively located at an upper portion and a lower portion of the lateral opening thereby forming a pivoting portion on the lever section. A first abutting surface and a second abutting surface, which are separated with a preferred angle, are respectively formed at a lateral end of the pivoting portion and an outer corner edge of the pivoting portion. The second connecting rod comprises a first end and a second end. Wherein the first end further has a T-shaped pivot rod which protrudes from an outer surface thereof and is configured to be received in the lateral opening. As a result, the pivot rod is configured to be secured by the engaging portions, and the second connecting rod is configured to be pivotally connected to the first connecting rod. Through pulling the second connecting rod, the first end of the second connecting rod is configured to selectively bear against the first abutting surface or the second abutting surface, thus allowing the toilet tank lever of the present invention to be applied to different types of toilet water tanks which have their toilet tank levers installed at different positions thereon.

Comparing with conventional toilet tank lever, the present invention is advantageous because: the first connecting rod and the second connecting rod are pivotally connected with an adjustable included angle such that the toilet tank lever of the present invention is configured to be applied to different types of the toilet water tanks thereby improving the practicability thereof.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
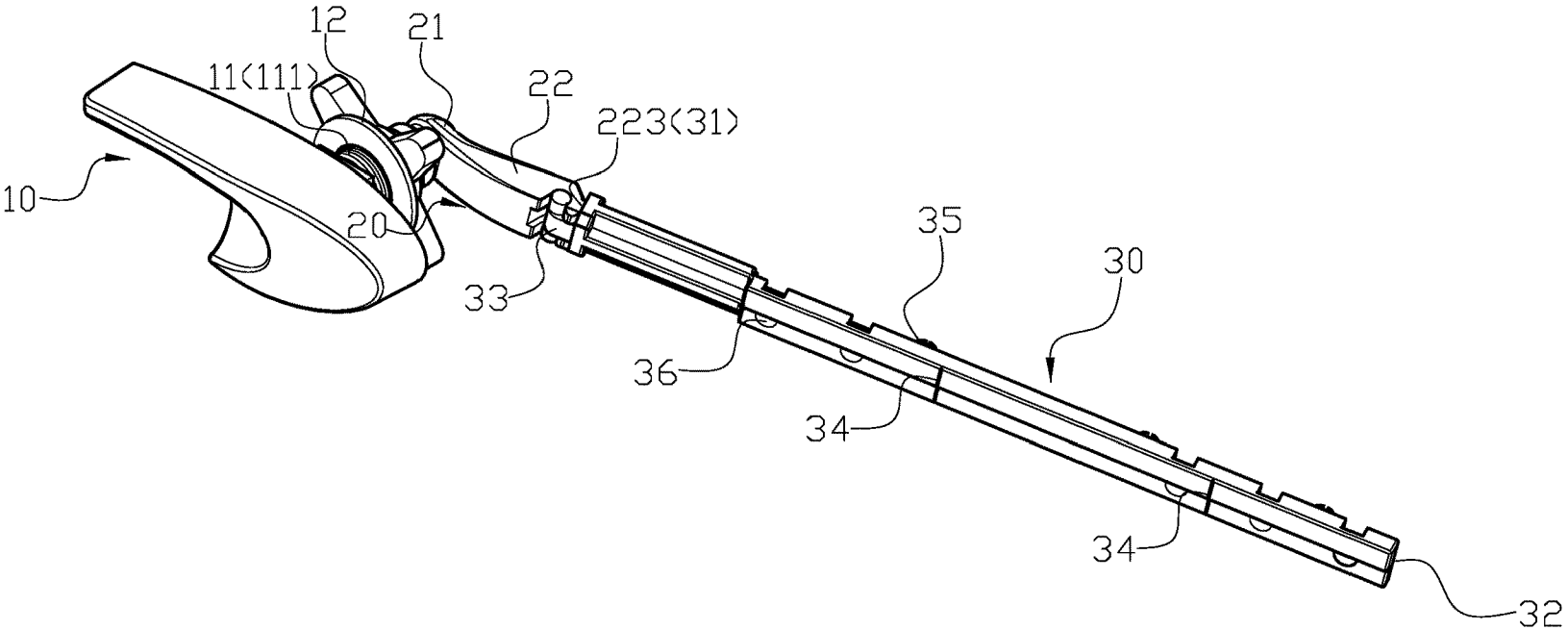
FIG. 1 is a three-dimensional assembly view of a toilet tank lever of the present invention.
Figure 2:
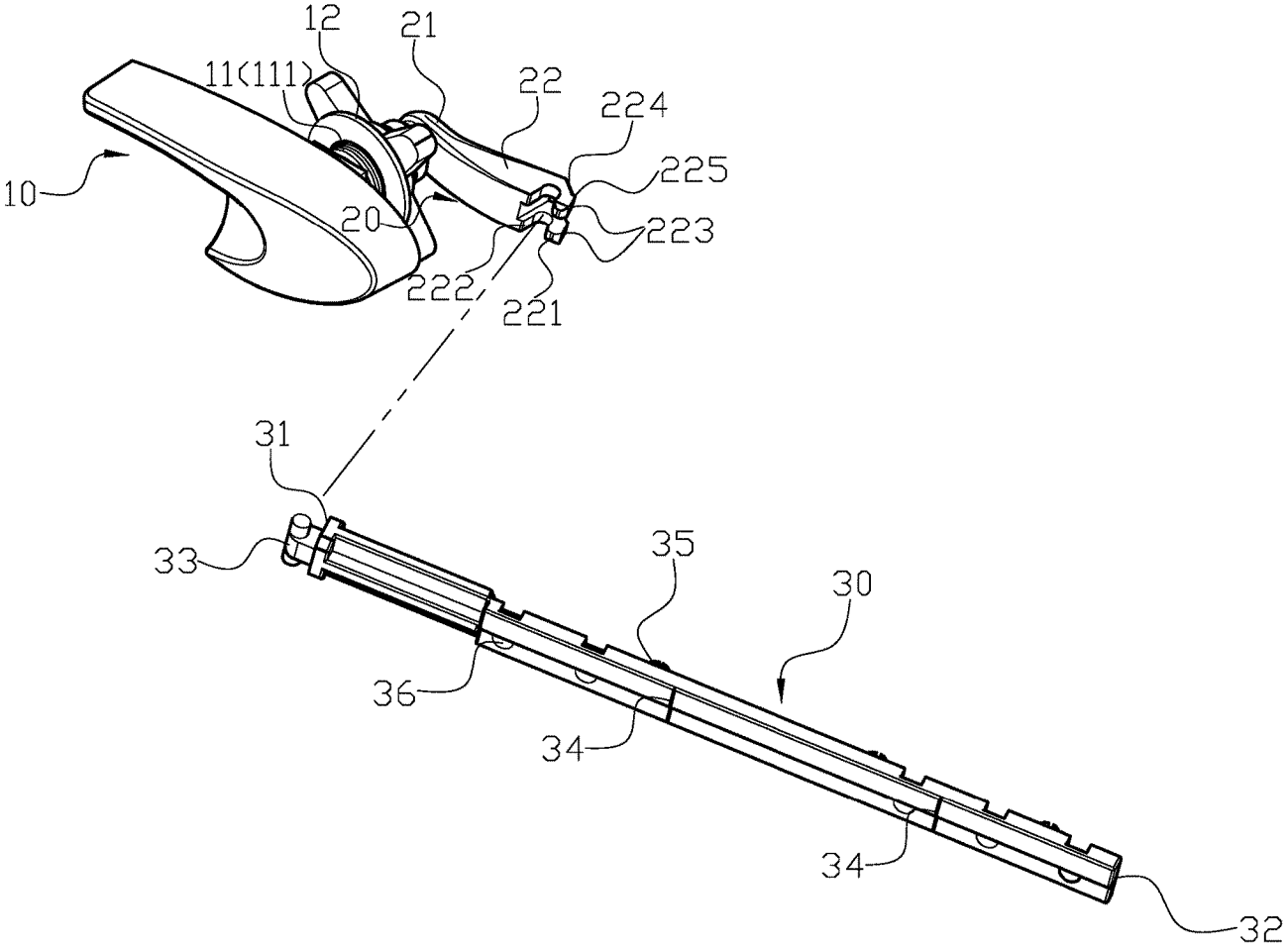
FIG. 2 is a three-dimensional exploded view of the toilet tank lever of the present invention.
Figure 3:
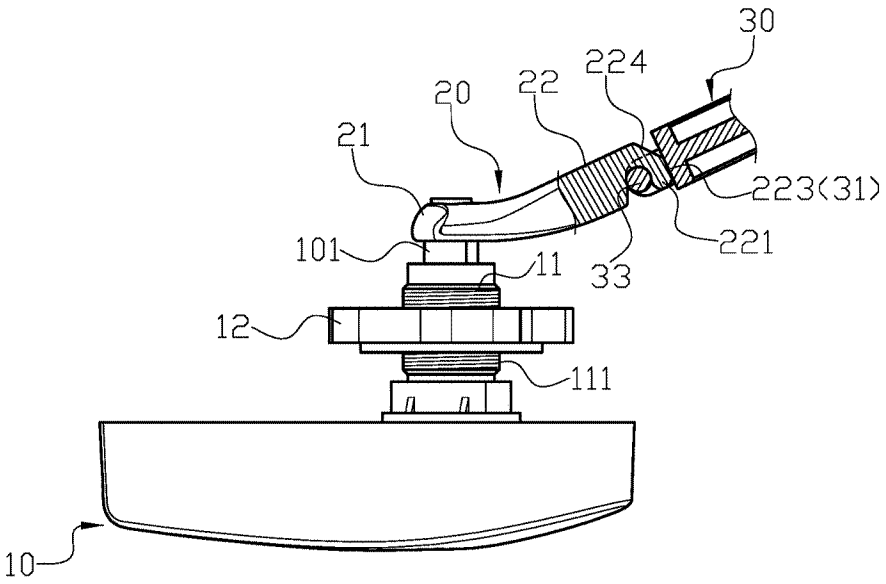
FIG. 3 is a sectional assembly view of the toilet tank lever of the present invention.

In order to further understand the goal, characteristics and effect of the present invention, a number of embodiments along with the drawings are illustrated as following:

Referring to FIGS. 1 to 3, the present invention provides a toilet tank lever which comprises a flush handle (10), a first connecting rod (20) and a second connecting rod (30). The flush handle (10) is configured to control a toilet to flush, and a column (101) protrudes from an inner surface thereof. A locating piece (11) disposed on the column (101) is configured to have preferred rotations when the flush handle (10) is pressed for flushing toilet. A threaded section (111) formed on an outer periphery of the locating piece (11) is configured to engage with a locating nut (12). Moreover, an end portion of the column (101) is configured to connect to the first connecting rod (20). The first connecting rod (20) has a fixed section (21) and a lever section (22). Wherein the fixed section (21) is configured to connect to the column (101) of the flush handle (10) such that the flush handle (10) is configured to drive the first connecting rod (20) through the column (101) to move simultaneously. The lever section (22) has a lateral opening (222), and two engaging portions (221) are respectively located at an upper portion and a lower portion of the lateral opening (222) thereby forming a pivoting portion on the lever section (22). A first abutting surface (223) and a second abutting surface (224), which are separated with a preferred angle, are respectively formed at a lateral end of the pivoting portion and an outer corner edge of the pivoting portion. The second connecting rod (30) comprises a first end (31) and a second end (32). Wherein the first end (31) further has a T-shaped pivot rod (33) which protrudes from an outer surface thereof and is configured to be received in the lateral opening (222). As a result, the pivot rod (33) is configured to be secured by the engaging portions (221), and the second connecting rod (30) is configured to be pivotally connected to the first connecting rod (20). Through pulling the second connecting rod (30), the first end (31) of the second connecting rod (30) is configured to selectively bear against the first abutting surface (223) or the second abutting surface (224), thus allowing the toilet tank lever of the present invention to be applied to different types of toilet water tanks which have their toilet tank levers installed at different positions thereon.

Figure 4:
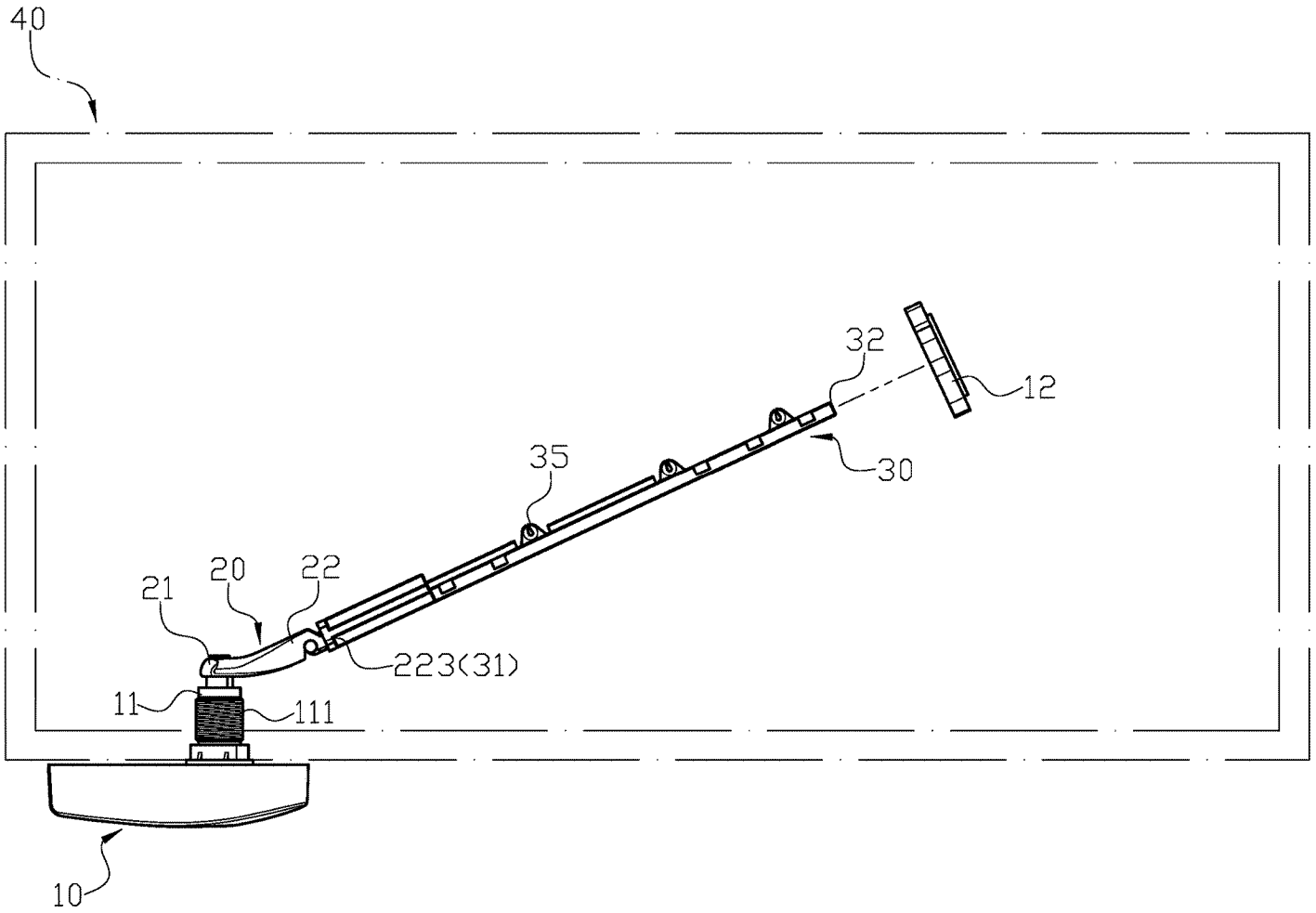
FIG. 4 is a schematic view illustrating a locating nut of the toilet tank lever is engaged back with a threaded section of a flush handle in the present invention.
Figure 5:
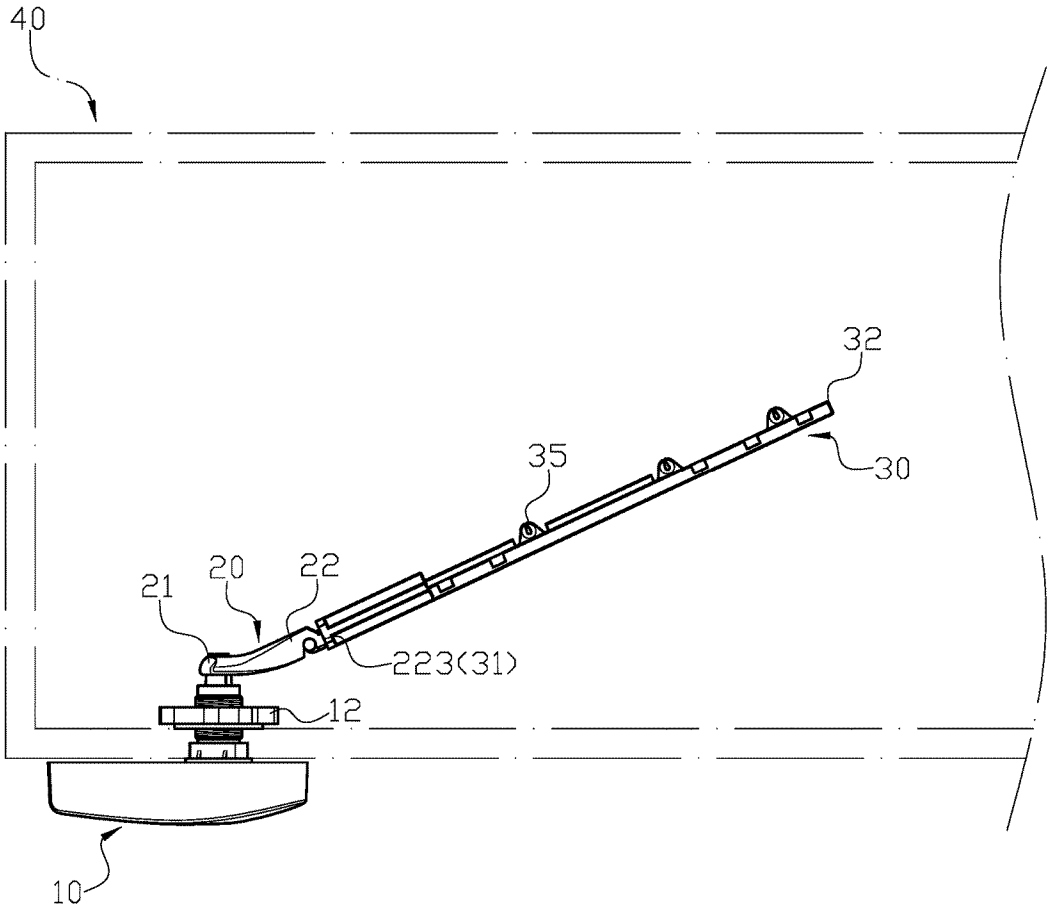
FIG. 5 is a schematic view illustrating the toilet tank lever is installed at a front side of a toilet water tank in the present invention.
Figure 6:
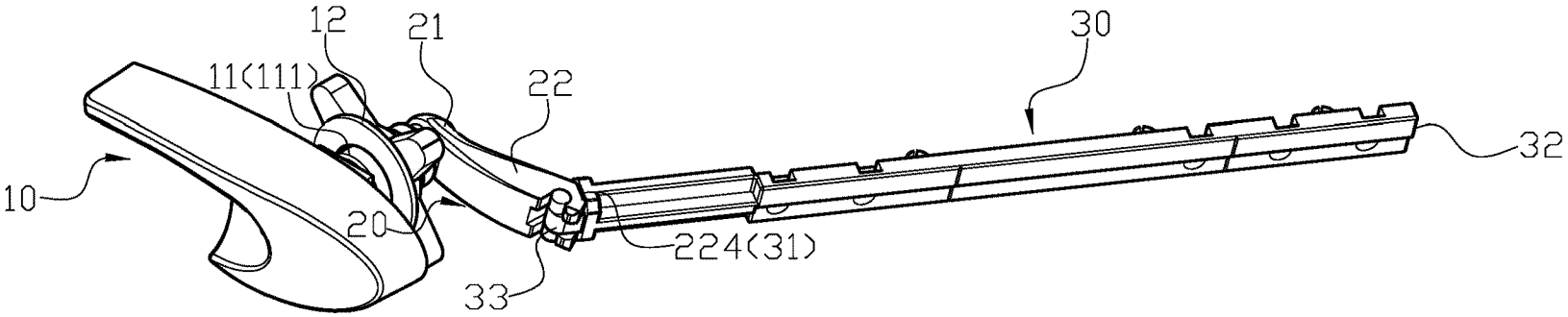
FIG. 6 is a three-dimensional assembly view illustrating a first connecting rod and a second connecting rod of the toilet tank lever are connected with an adjustable preferred angle in the present invention.
Figure 7:
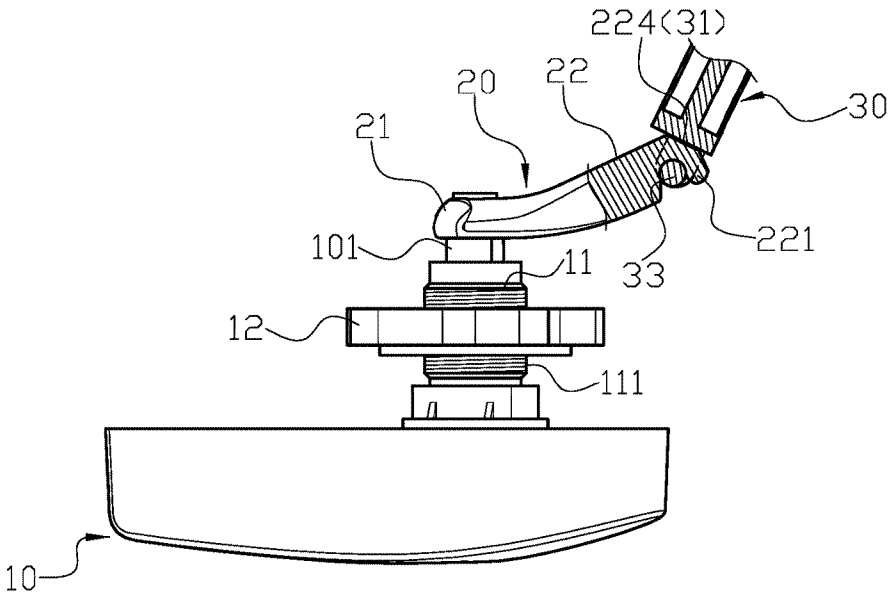
FIG. 7 is a plan view illustrating the first connecting rod and the second connecting rod of the toilet tank lever are connected with an adjustable preferred angle in the present invention.
Figure 8:
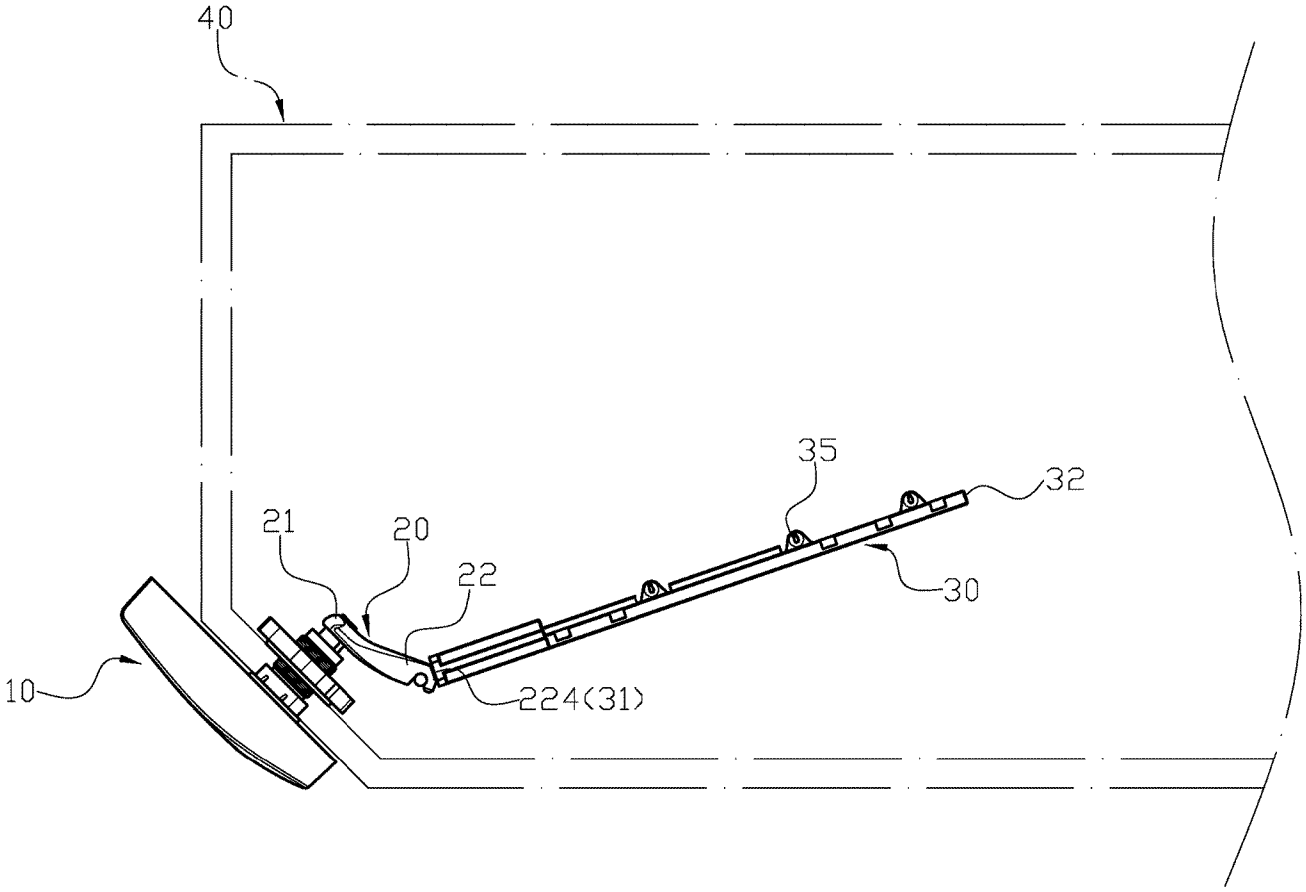
FIG. 8 is a schematic view illustrating the toilet tank lever is installed at a corner of the toilet water tank in the present invention.
Figure 9:
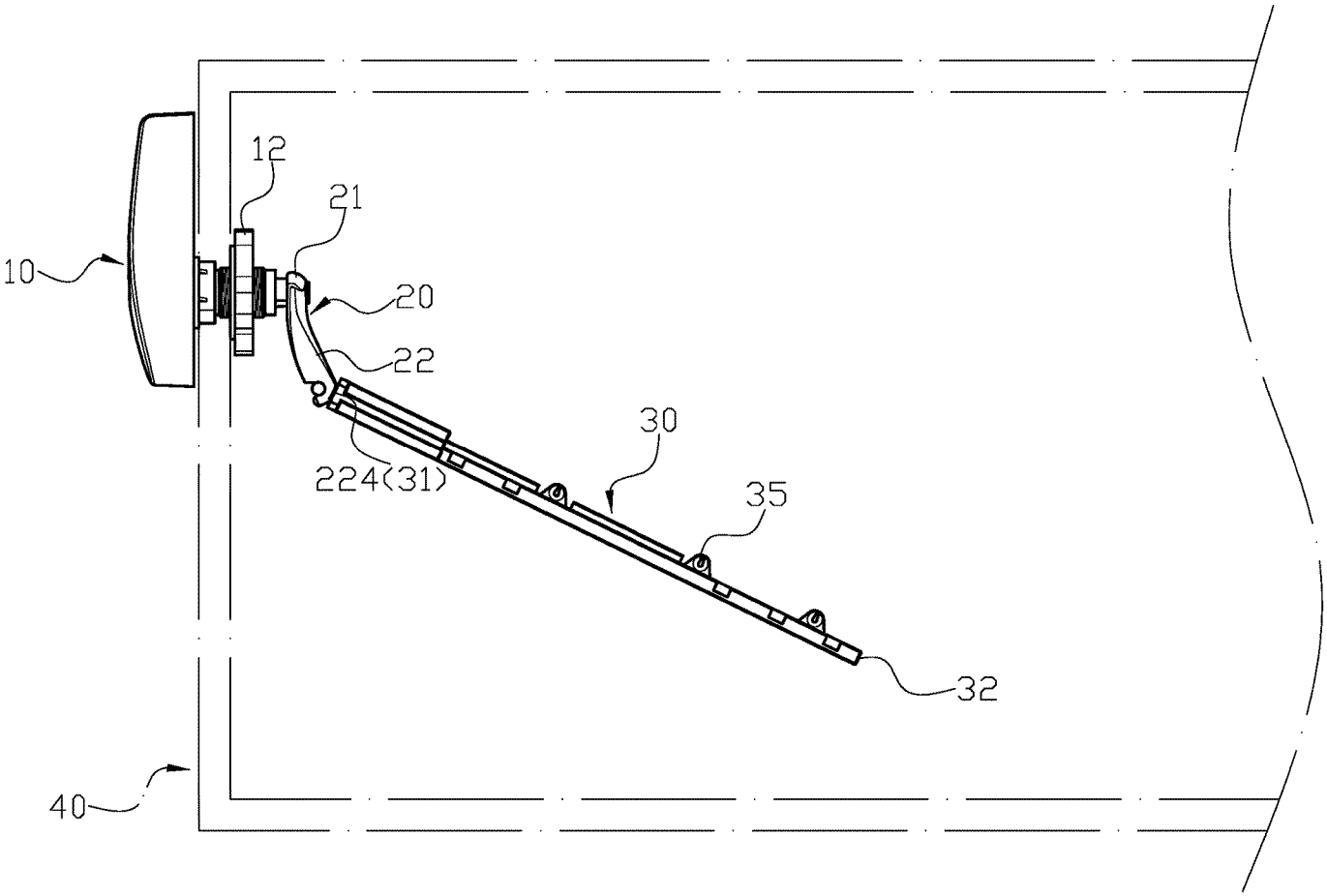
FIG. 9 is a schematic view illustrating the toilet tank lever is installed at a lateral edge of the toilet water tank in the present invention.

In actual application, a toilet water tank (40) has a through hole which is configured to install the toilet tank lever. Through pulling the second connecting rod (30) to change a connecting angle between the first connecting rod (20) and the second connecting rod (30), the toilet tank lever of the present invention is configured to be applied to different types of toilet water tanks (40) which have their through holes at different positions thereon. In one embodiment, the through hole is located at a front side of the toilet water tank (40). A user can disengage the locating nut (12) from the threaded section (111) to allow the second connecting rod (30), the first connecting rod (20) and the locating piece (11) to sequentially penetrate through the through hole into an interior space of the toilet water tank (40), and then engage the locating nut (12) back with the threaded section (111) (as shown in FIG. 4). By using the first end (31) of the second connecting rod (30) to bear against the first abutting surface (223) of the first connecting rod (20), the first connecting rod (20) and the second connecting rod (30) are configured to be aligned (as shown in FIG. 5) such that the second connecting rod (30) is configured to connect to a pulling unit of a sealing valve of the toilet water tank (40). In another embodiment, the through hole is located at a corner or a lateral portion of the toilet water tank (40). A user can pull the second connecting rod (30) toward an opposite side of the flush handle (10) such that the first end (31) of the second connecting rod (30) is configured to bear against the second abutting surface (224) of the first connecting rod (20) (as shown in FIGS. 6 and 7). As a result, the first connecting rod (20) and the second connecting rod (30) are connected with a preferred angle such that the toilet tank lever of the present invention is configured to be located at a corner (as shown in FIG. 8) or a lateral edge (as shown in FIG. 9) of the toilet water tank (40), thus allowing the second connecting rod (40) to successfully connect to the pulling unit of the sealing valve the toilet water tank (40). Wherein the pulling unit is a bead chain (50) or a link chain (60).

In one embodiment, a stepped portion (225) is formed between the first abutting surface (223) and the second abutting surface (224) to allow a user to effectively distinguish that the second connecting rod (30) is connected to the first abutting surface (223) or the second abutting surface (224) of the first connecting rod (20).

In another embodiment, an included angle between the fixed section (21) and the lever section (22) of the first connecting rod (20) is about 155 degrees.

Figure 10:
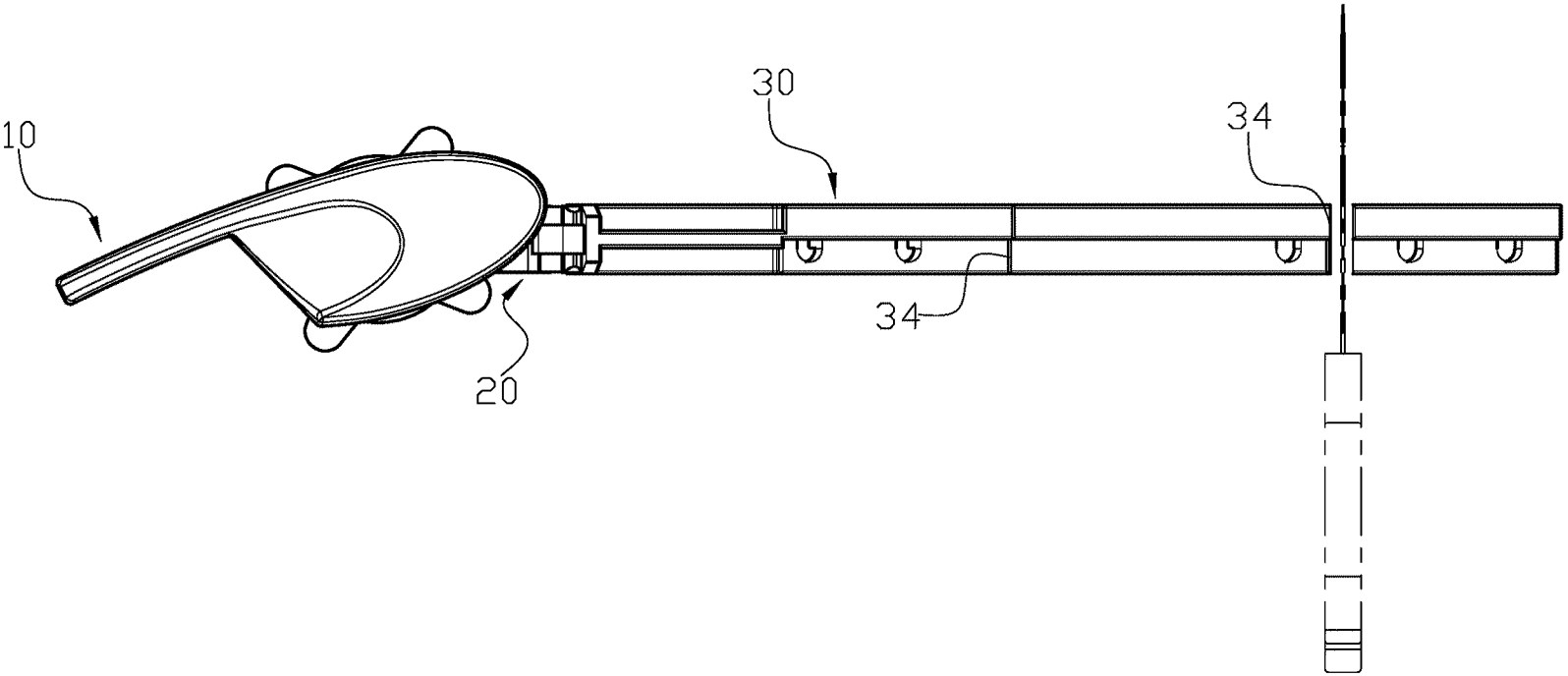
FIG. 10 is a schematic view illustrating the toilet tank lever of the present invention is cut.

In still another embodiment, a surface of the second connecting rod (30) has a plurality of marked lines (34) which are separated with preferred distances, and the marked lines (34) are configured to provide indications when the second connecting rod (30) is too long and needs to be cut (as shown in FIG. 10).

Figure 11:
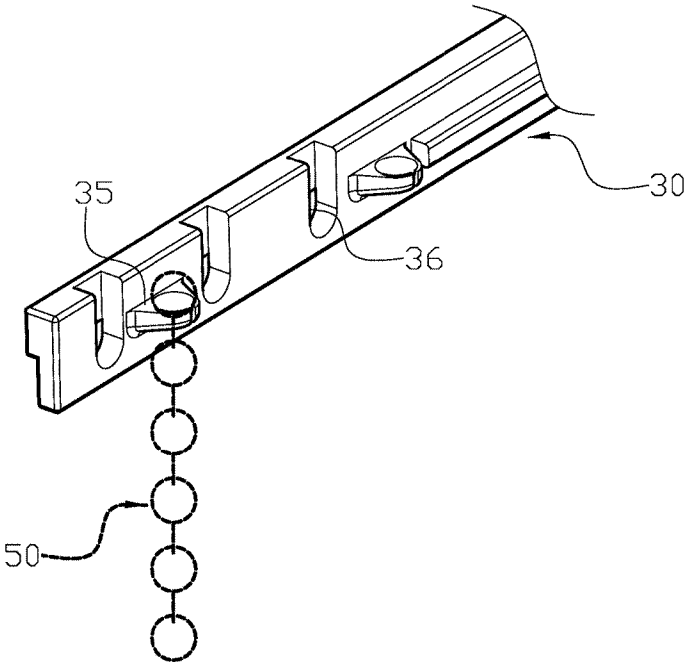
FIG. 11 is a schematic view illustrating a bead chain is hung on the second connecting rod.

In a further embodiment, the second connecting rod (30) has a plurality of hangers (35) which are configured to be selected to hang a bead chain (50) thereon (as shown in FIG. 11).

Figure 12:
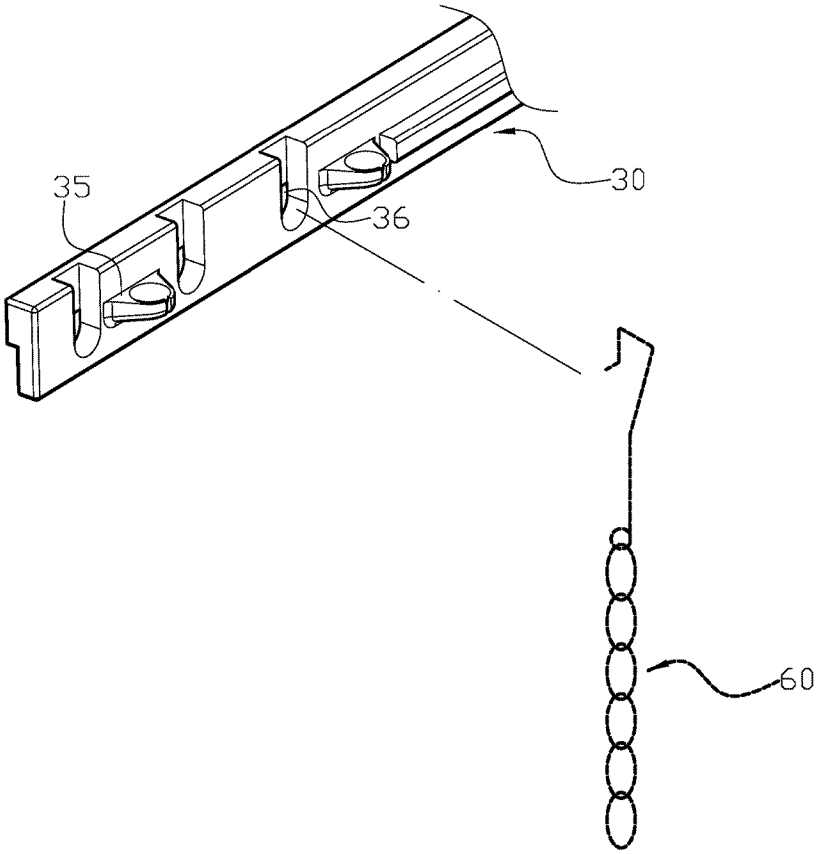
FIG. 12 is a schematic view illustrating a link chain is hung on the second connecting rod.

In still a further embodiment, the second connecting rod (30) comprises a plurality of hanging holes (36) which are configured to be selected to hang a link chain (60) thereon (as shown in FIG. 12).

In yet a further embodiment, the second connecting rod (30) has a plurality of the hangers (35) and the hanging holes (36) to allow one of different pulling units to be selectively hung thereon.

Comparing with conventional toilet tank lever, the present invention is advantageous because: the first connecting rod (20) and the second connecting rod (30) are pivotally connected with an adjustable included angle such that the toilet tank lever of the present invention is configured to be applied to different types of the toilet water tanks (40) thereby improving the practicability thereof.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A toilet tank lever comprising:

a flush handle configured for flushing a toilet, and a column protruding from an inner surface thereof; a locating piece, which is disposed on the column and configured to rotate when the flush handle is pressed for flushing toilet; a threaded section, which is formed on an outer periphery of the locating piece, configured to engage with a locating nut;

a first connecting rod connected with an end portion of the column having a fixed section and a lever section; wherein the fixed section is configured to connect to the column of the flush handle such that the flush handle is configured to drive the first connecting rod through the column to move simultaneously, and wherein the lever section has a lateral opening, and two engaging portions are respectively located at an upper portion and a lower portion of the lateral opening thereby forming a pivoting portion on the lever section; a first abutting surface and a second abutting surface, which are separated with a predetermined angle, respectively formed at a lateral end of the pivoting portion and an outer corner edge of the pivoting portion; and a second connecting rod comprising a first end and a second end; wherein the first end further has a T-shaped pivot rod having a vertical portion which vertically protrudes from an outer surface thereof and a horizontal portion horizontally extending from a top portion of both sides of the vertical portion, and the horizontal portion is configured to be received in the lateral opening while the vertical portion is secured between the two engaging portions to pivotally connect to the first connecting rod; and through pulling the second connecting rod, the first end of the second connecting rod configured to selectively bear against the first abutting surface or the second abutting surface of the first connecting rod, thus adjusting a connecting angle between the first connecting rod and the second connecting rod according to a installed position on a toilet water tank for the toilet tank lever.

2. The toilet tank lever of claim 1, wherein a stepped portion is formed between the first abutting surface and the second abutting surface.

3. The toilet tank lever of claim 1, wherein an included angle between the fixed section and the lever section is about 155 degrees.

4. The toilet tank lever of claim 1, wherein a surface of the second connecting rod has a plurality of marked lines which are separated with predetermined distances.

5. The toilet tank lever of claim 1, wherein the second connecting rod has a plurality of hangers formed thereon, and each of the hangers has at least a first hanging hole.

6. The toilet tank lever of claim 1, wherein the second connecting rod comprises a plurality of second hanging holes formed thereon.

7. The toilet tank lever of claim 1, wherein the second connecting rod has a plurality of hangers and a plurality of second hanging holes, which are respectively formed thereon, and wherein each of the hangers comprises at least a first hanging hole.

* * * * *